US006131866A

United States Patent [19]

Kesinger

[11] Patent Number: 6,131,866

[45] Date of Patent: Oct. 17, 2000

[54] UNIVERSAL TRACK HANGER ASSEMBLY

[76] Inventor: Eric S. Kesinger, 468 S. Balsam St., Lakewood, Colo. 80226

[21] Appl. No.: 09/192,978

[22] Filed: Nov. 16, 1998

Related U.S. Application Data

[60] Provisional application No. 60/065,743, Nov. 17, 1997.

[51] Int. Cl.[7] ..... A47B 96/06

[52] U.S. Cl. ..... 248/225.11; 211/182; 248/225.21; 248/225.52

[58] Field of Search ..... 248/225.11, 225.21, 248/225.52, 239, 244, 245, 221.11, 220.2; 211/153, 182

[56] References Cited

U.S. PATENT DOCUMENTS

| | | | |
|---|---|---|---|
| 1,821,083 | 9/1931 | Visel | 312/140 |
| 2,744,714 | 5/1956 | Parke | 248/245 |
| 2,767,951 | 10/1956 | Cousino | 248/245 |
| 2,859,710 | 11/1958 | Elsner | 248/222.52 |
| 2,876,978 | 3/1959 | Robinson | 248/245 |
| 2,937,766 | 5/1960 | Penn | 248/239 |
| 3,250,584 | 5/1966 | Tassell | 312/255 |
| 3,255,987 | 6/1966 | Gatch | 248/220 |
| 3,443,783 | 5/1969 | Fisher | 248/239 |
| 3,513,606 | 5/1970 | Jones | 211/182 X |
| 4,212,445 | 7/1980 | Hagen | 248/245 |
| 4,226,394 | 10/1980 | Einhorn | 248/225.1 |
| 4,450,655 | 5/1984 | Rosenthal et al. | 52/36 |
| 4,903,928 | 2/1990 | Shell | 248/225.1 |
| 5,154,385 | 10/1992 | Lindberg et al. | 248/225.1 |
| 5,356,104 | 10/1994 | Rosenberg et al. | 248/220.2 |
| 5,407,170 | 4/1995 | Slivon et al. | 248/552 |
| 5,794,901 | 8/1998 | Sigel | 248/221.11 |

*Primary Examiner*—Ramon O. Ramirez
*Assistant Examiner*—Tan Le
*Attorney, Agent, or Firm*—Flanagan & Flanagan; John K. Flanagan; John R. Flanagan

[57] ABSTRACT

A universal track hanger assembly includes an elongated track, a plurality of slide members and a plurality of hanging elements. The track defines a longitudinal channel having a substantially rectangular configuration in transverse cross-section and a longitudinal slot opening to the channel. The slide member is disposable at least partially within the channel of the track and is slidably movable longitudinally within the channel. The slide member is securable at selected locations along the track in relation to the track. The hanging element is insertable through and removable from the slot of the track and attachable to and removable from and movable with the slide member. The hanging element and slide element also are movable in relation to one another and movable in relation to the track between a first position and a second position. In the first position, the hanging element and slide member are loosened relative to the track and thereby permitted to undergo longitudinal slidable movement along the track so as to permit placement of the hanging element and slide member at a desired location along the track. In the second position, the hanging element and slide member are tightened relative to the track and thereby secured at the desired location along the track so as to prevent their displacement along the track from the desired location.

11 Claims, 4 Drawing Sheets

UNIVERSAL TRACK HANGER ASSEMBLY

This patent application claims the benefit of provisional application No. 60/065,743 filed on Nov. 17, 1997.

BACKGROUND OF THE INVENTION

1. Field of the Invention

The present invention generally relates to means for hanging items and, more particularly, is concerned with a universal track hanger assembly.

2. Description of the Prior Art

Homes and businesses often have limited space for the storage and/or display of items. For this reason, it is often desirable to hang items below ceilings and/or along walls inside rooms. Systems have been developed over the years which attach to ceilings and/or walls for the storage and/or display of items. A representative example of a prior art hanger system is disclosed in U.S. Pat. No. 4,226,394 to Einhorn. Common features in the Einhorn and in other prior art hanger systems include a track mounted to a ceiling and/or on a wall and one or more hanging elements which are attachable to and may be slidable along the track. These prior art hanger systems appear to allow for convenient storage and/or display of items and thereby provide a means for using as much space as possible in a room.

A problem exists, however, in that many of these prior art hanger systems have such specific designs that few or no commercially available components can be used as part thereof or in conjunction therewith. Consequently, a need still exists for an assembly which provides a solution to the aforementioned problem in the prior art without introducing any new problems in place thereof.

SUMMARY OF THE INVENTION

The present invention provides a universal track hanger assembly designed to satisfy the aforementioned need. The universal track hanger assembly of the present invention allows for the storage and/or display of tools, bicycles and other items below ceilings and along walls. Such capability will solve the aforementioned problem in the prior art by allowing for the use of a variety of commercially available hanging elements as part of the assembly. This feature of the universal track hanger assembly of the present invention improves upon prior art hanger systems by affording more versatility and lowering the cost of manufacture with the capability to employ commercially available hanging elements.

Accordingly, the present invention is directed to a universal track hanger assembly which comprises: (a) an elongated track defining a longitudinal channel having a longitudinal slot opening to the channel; (b) at least one slide member disposable at least partially and slidably movable longitudinally within the channel of and securable at selected locations along the track in relation to the track; and (c) at least one hanging element insertable through and removable from the slot of the track and attachable to and removable from and movable with the slide member, the hanging element and slide member also being movable in relation to one another and movable in relation to the track between a first position and a second position such that in the first position the hanging element and slide member are loosened relative to the track and thereby permitted to undergo longitudinal slidable movement along the track so as to permit placement of the hanging element and slide member at a desired location along the track and in the second position the hanging element and slide member are tightened relative to the track and thereby secured at the desired location along the track so as to prevent their displacement along the track from the desired location.

In a preferred embodiment, the slide member includes a rear retaining portion disposable within and slidable along the channel of the track and adapted to retain the hanging element in sliding relation to the track, a front gripping portion disposable externally of and adjacent to the track and adapted to be gripped by a user, and a middle connecting portion disposable substantially within the slot of the track and extending between and interconnecting the rear retaining and front gripping portions. The slide member has an internally threaded opening defined through the rear retaining, front gripping and middle connecting portions and aligned with the slot of the track. The hanging element has a hanger portion for extending from the track and which can have various configurations and an externally threaded end portion threadably insertable within and removable from the internally threaded opening of the slide member. The slide member is rotatable in opposite directions for threadably inserting and removing the end portion of the hanging element into and from the opening of the slide member and for moving the hanging element and slide member between the first and second positions.

The track includes a back wall, a pair of opposite side walls connected at rear edges to and extending forwardly from the back wall, and a pair of opposing front wall ledges connected along front edges of the side walls and being spaced forwardly from the back wall and extending toward one another so as to define the longitudinal slot therebetween. The end portion of the hanging element in the first position is spaced from the back wall of the track. The end portion of the hanging element in the second position is tightened against the back wall of the track and the rear retaining portion of the slide member is thereby tightened against the opposing front wall ledges of the track.

In a modification of the preferred embodiment of the assembly, the slide member of the assembly has a two-piece configuration rather than the one-piece configuration in the preferred embodiment. The middle portion of the slide member is not connected to the rear retaining portion thereof. It is the front wall ledges of the track that are clamped between the middle portion and rear retaining portion of the slide member so as to retain the hanging element in the second position rather than the end portion of the hanging element being tightened against the back wall of the track as in the preferred embodiment.

In an alternative embodiment of the assembly, the slide member is made up only of the rear retaining portion of the slide member of the preferred embodiment. The slide member has a substantially rectangular configuration conforming to the configuration of the channel of the track. The slide member defines an internally threaded opening aligned with the slot of the track. The hanging element has an externally threaded end portion threadably insertable within and removable from the internally threaded opening of the slide member. The hanging element is rotatable in opposite directions for threadably inserting and removing the end portion of the hanging element into and from the opening of the slide member and for moving the end portion of the hanging element between the first and second positions. The end portion of the hanging element in the first position is spaced from the back wall of the track. The end portion of the hanging element in the second position is tightened against the back wall of the track and the slide member is thereby tightened against the opposing front wall ledges of the track.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description reference will be made to the attached drawings in which.

DETAILED DESCRIPTION OF THE INVENTION

Figure 1:
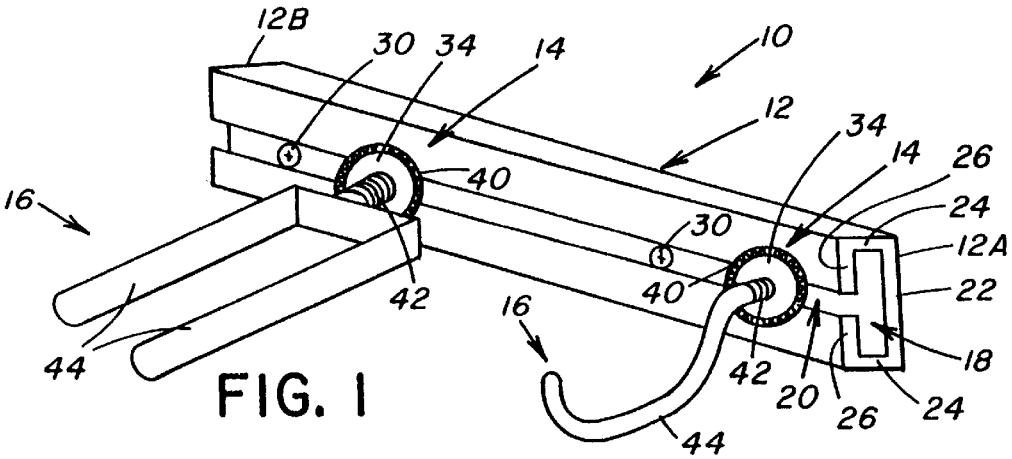
FIG. 1 is a perspective view of a preferred embodiment of a universal track hanger assembly of the present invention showing a track, a pair of slide members and a pair of hanging elements of the assembly.

Referring to the drawings and particularly to FIGS. 1 to 5, there is illustrated a preferred embodiment of a universal track hanger assembly, generally designated 10, of the present invention. Basically, the universal track hanger assembly 10 includes an elongated track 12, at least one and, preferably, a plurality of slide members 14 and at least one and, preferably, a plurality of hanging elements 16. The track 12 defines a longitudinal channel 18 having a substantially rectangular configuration in transverse cross-section and a longitudinal slot 20 opening to the channel 18. The slide member 14 is disposable at least partially within the channel 18 of the track 12 and is slidably movable longitudinally within the channel 18 of the track 12. The slide member 14 is securable at selected locations along the track 12 in relation to the track 12. The hanging element 16 is insertable through and removable from the slot 20 of the track 12 and attachable to and removable from and movable with the slide member 14. Also, the hanging element 16 and slide member 14 are movable in relation to one another and movable in relation to the track 12 between a first position, as shown in dashed line form in FIG. 2, and a second position, as shown in solid line form in FIG. 2. In the first position, the hanging element 16 and slide member 14 are loosened relative to the track 12 and thus permitted to undergo longitudinal slidable movement along the track 12 so as to permit placement of the hanging element 16 and slide member 14 at a desired location along the track 12. In the second position, the hanging element 16 and slide member 14 are tightened relative to the track 12 and thus secured at the desired position along the track 12 so as to prevent their displacement along the track 12 from the desired position.

Figure 2:
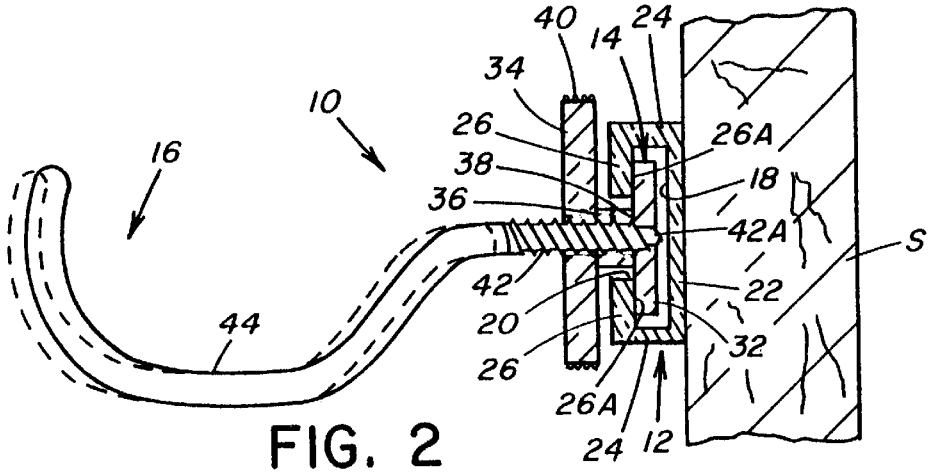
FIG. 2 is an enlarged partially cross-sectional and partially side elevational view of the assembly of FIG. 1, showing in cross-section the track and one of the slide members and in side elevation one of the hanging elements, with the assembly shown mounted to an external structural member.
Figure 3:
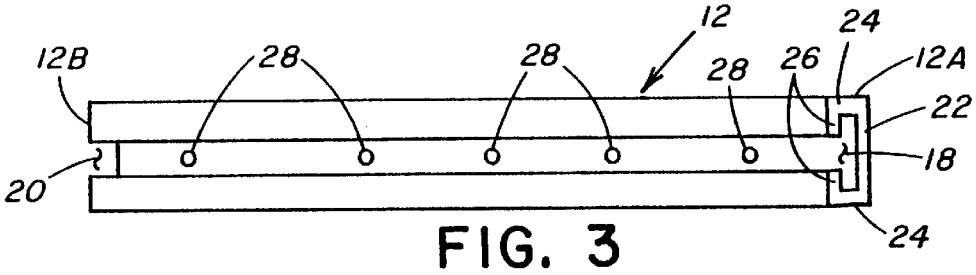
FIG. 3 is a perspective view of the track of the assembly of FIG. 1.

Referring to FIGS. 1 to 3, the elongated track 12 has opposite ends 12A, 12B. The channel 18 and slot 20 extend the full longitudinal length of the track 12 and are open at the ends 12A, 12B of the track 12. The channel 18 and slot 20 are provided in communication with one another and together have a substantially T-shaped configuration in transverse cross-section. The track 12 has a substantially rectangular configuration in transverse cross-section interrupted by the slot 20. The track 12 is comprised of a substantially rigid metal material, such as aluminum, but can be made of any other suitable material. More particularly, the track 12 includes a back wall 22, a pair of opposite side walls 24 connected dt rear edges to and extending forwardly from the back wall 22, and a pair of opposing front wall ledges 26 connected along front edges of the side walls 24 and being spaced forwardly from the back wall 22 and extending toward one another so as to define the longitudinal slot 20 therebetween. The back wall 22 and the opposing front wall ledges 26 are provided in substantially parallel relation to one another. The opposite side walls 24 are in substantially parallel relation to one another and in substantially perpendicular relation to the back wall 22 and opposing front wall ledges 26. The back wall 22, opposite side walls 24 and opposing front wall ledges 26 have uniform thickness. The widths of the opposing front wall ledges 26 are substantially the same, greater than the width of the opposite side walls 24, and less than the width of the back wall 22. The back wall 22 defines a plurality of holes 28 which are spaced apart from one another and aligned in series relation along a centerline of and extend along a longitudinal length of the back wall 22. The assembly 10 further includes a plurality of fasteners 30 for mounting the track 12 to an external support structure S of a building (not shown). Each fastener 30 is adapted for insertion through one of the holes 28 of the back wall 22 of the track 12 and into the external structural member S. The external structural member S may be a ceiling, a wall or the like. Each fastener 30 is a conventional screw or of any other suitable type.

Referring to FIGS. 1, 2, 4 and 5, each slide member 14 includes a rear retaining portion 32, a front gripping portion 34 and a middle portion 36. The portions 32, 34, 36 are all rigidly interconnected to one another. The rear retaining portion 32 of each slide member 14 is disposable within and slidable along the channel 18 of the track 12 and adapted to retain the hanging element 16 in sliding relation to the track 12. The front gripping portion 34 of each slide member 14 is disposable externally of and adjacent to the track 12 and is adapted to be gripped by a user to turn (loosen or tighten) the slide member 14. The middle portion 36 of each slide member 14 is disposable substantially within the slot 20 of the track 12 and extends between and interconnects the rear retaining portion 32 and front gripping portions 34 so as to provide the slide member 14 in a one-piece configuration. Each of the retaining, gripping and connecting portions 32, 34, 36 has a substantially circular configuration, though may have any other suitable shape. The diameter of the retaining portion 32 is less than the diameter of the gripping portion 34 and greater than the diameter of the connecting portion 36. The slide member 14 is comprised of a substantially rigid metal material, such as aluminum, but can be made of any other suitable material.

In the preferred embodiment, each slide member 14 has an internally threaded opening 38 defined through the rear retaining portion 32, front gripping portion 34 and middle connecting portion 36. The opening 38 of the slide member 14 is aligned with the slot 20 of the track 12. The opening 38 is centrally located through the slide member 14. The width of the channel 18 of the track 12 is only slightly greater than the diameter of the rear retaining portion 32 of the slide member 14 for providing a secure fit and at the same time permitting rotation and sliding movement of the rear retaining portion 32 of the slide member 14 within the channel 18 of the track 12. The slot 20 of the track 12 has a width between the opposing front wall ledges 26 of the track 12 that is only slightly greater than the diameter of the middle connecting portion 36 of the slide member 14 for providing a secure fit and at the same time permitting rotation and sliding movement of the middle connecting portion 36 within the slot 20 of the track 12. The front gripping portion 34 has an annular outer surface 40. The outer surface 40 is roughened or knurled to provide a more effective gripping surface for a user. The slide member 14 is rotatable in opposite directions, either in a clockwise or a counterclockwise direction, relative to the track 12. The front gripping portion 34 also has a circular front surface 34A. The front surface 34A is smooth and has the words "Turn To Lock" and an arrow indicating the direction to do so printed thereon.

Referring to FIGS. 1, 2 and 6 to 9, each hanging element 16 has an end portion 42 for extending through the slide member 14 and a hanger portion 44 for extending from the track 12. The end portion 42 and the hanger portion 44 are integrally formed with one another. The end portion 42 has a substantially straight configuration and is externally threaded. The end portion 42 is threadably insertable within and removable from the internally threaded opening 38 of the slide member 14. The hanger portion 44 of the hanging element 16 may have any suitable configuration, for instance, the substantially J-shaped configuration shown in FIG. 6, the substantially U-shaped configuration shown in FIG. 7, the substantially L-shaped configuration shown in FIG. 8 and the substantially S-shaped configuration shown in FIG. 9. The particular configuration of the hanger portion 44 selected for use by a user will depend on the particular needs of the user. Each of the slide members 14 is made of a substantially rigid metal material, such as aluminum, but can be made of any other suitable material. The hanger portion 44 may be coated with a substantially rubber material, or with any other suitable material, so as to prevent scratching or other forms of damage to items hung thereon. The end portion 42 can have different sizes, as shown in FIGS. 6 to 9. The threads on the end portion 42 may be of different shapes and sizes, as shown in FIGS. 6 to 9. The openings 38 of the slide members 14 have different sizes, as well, for receiving the correspondingly sized end portions 42, as shown in FIGS. 6 to 9.

In the preferred embodiment of FIGS. 1 to 9, the slide member 14 is rotatable in opposite directions for threadably inserting and removing the end portion 42 of the hanging element 16 into and from the opening 38 of the slide member 14 and for moving the hanging element 16 and slide member 14 between the first and second positions. Particularly, the user may rotate the slide member 14 by grasping and turning the front gripping portion 34 in one direction so as to cause the end portion 42 of the hanging element 16, which is threadably inserted into the internally threaded opening 38 of the slide member 14, to be drawn further into the channel 18 of the track 12 toward the back wall 22 of the track 12 and in another direction so as to cause the end portion 42 of the hanging element 16 to be drawn away from the back wall 22 of the track 12. The end portion 42 of the hanging element 16 in the first position is spaced from the back wall 22 of the track 12, as seen in broken line form in FIG. 2. The end portion 42 of the hanging element 16 in the second position has an end 42A projecting rearwardly from the slide member 14 and tightened against the back wall 22 of the track 12, as seen in solid line form in FIG. 2, and the rear retaining portion 32 of the slide member 14 is thereby tightened against back sides 26A of the opposing front wall ledges 26 of the track 12. The tightening of the end portion 42 of the hanging element 16 and the slide member 14 is accomplished by the end portion 42 of the hanging element 16 first being brought into contact with the back wall 22 of the track 12 which results in the tightening of the rear retaining portion 32 of the slide member 14 against the opposing front wall ledges 26 of the track 12 upon further rotation of the gripping portion 34 of the slide member 14 in the appropriate direction. This process of tightening the rear retaining portion 32 of the slide member 14 within the channel 18 of the track 12 secures the slide member 14 and hanging element 16 at a desired location, preventing further longitudinal movement or displacement of the slide member 14 within the channel 18. The hanging element 16 is thus secured in place for use in hanging items. Loosening the rear retaining portion 32 of the slide member 14 within the channel 18 of the track 12 for relocating the hanging element 16 along the track 12 is the reverse of the above-described tightening process.

The above described preferred embodiment and hereinafter described modified and alternative embodiments of the assembly 10 are substantially similar to one another. Like reference numbers in FIGS. 1 to 20 refer to like elements of the respective assemblies of the present invention. Only the differences will be described hereafter.

Figure 5:
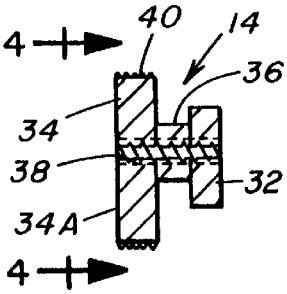
FIG. 5 is a cross-sectional view of the slide member taken along line 5—5 of FIG. 4.
Figure 4:
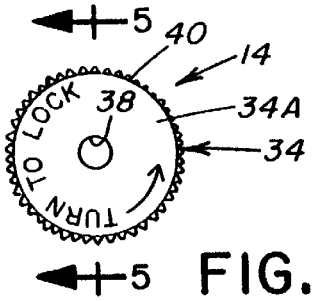
FIG. 4 is a front elevational view on a reduced scale of one of the slide members of the assembly of FIG. 1 as seen along line 4—4 of FIG. 5.
Figure 6:
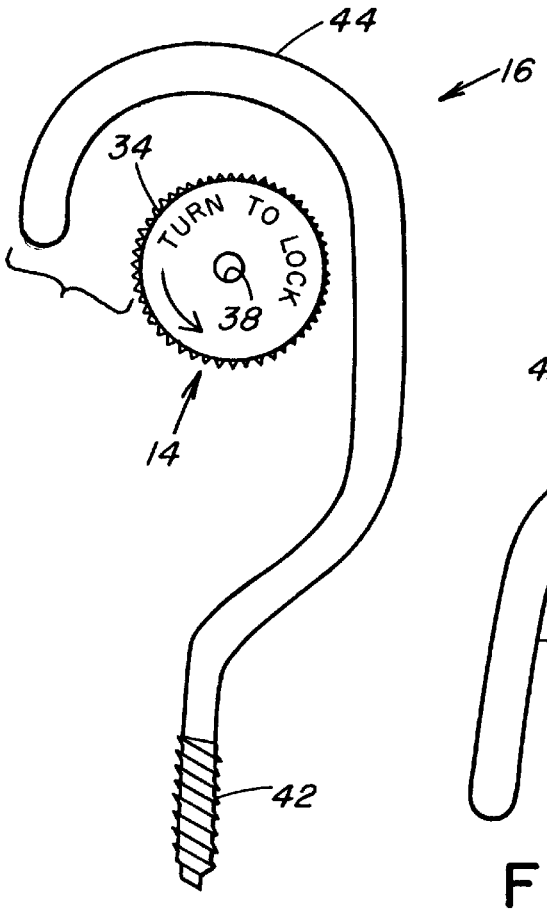
FIG. 6 is a plan view of a slide member and a first form of the hanging element of the assembly wherein the hanging element has a hanging portion of a substantially J-shaped configuration.
Figure 7:
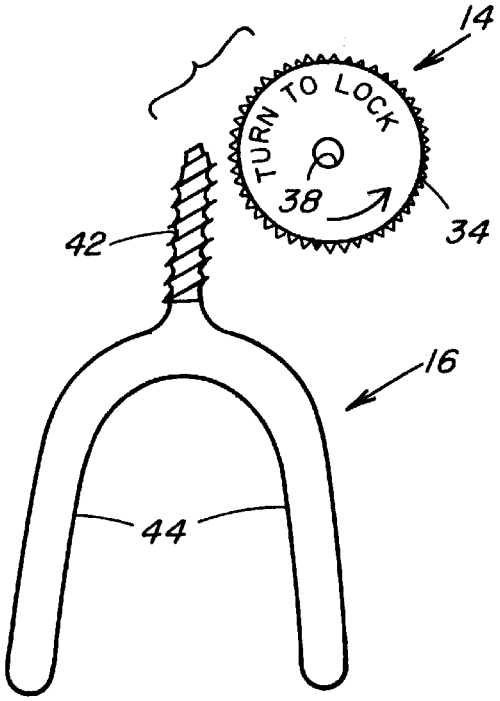
FIG. 7 is another plan view of a slide member and a second form of the hanging element of the assembly wherein the hanging portion of the hanging element has a substantially U-shaped configuration.
Figure 9:
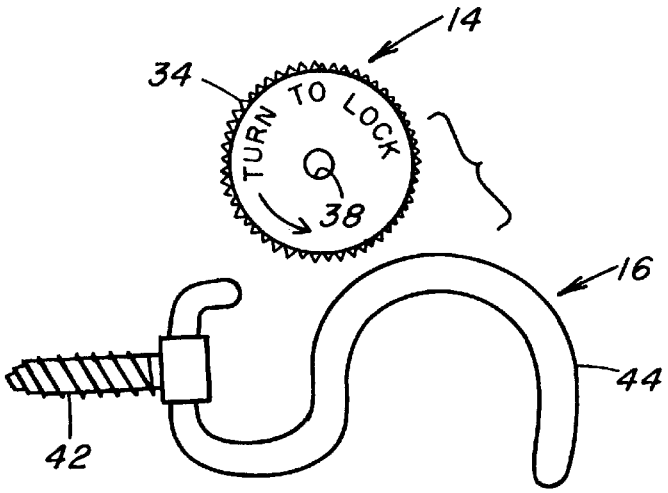
FIG. 9 is still another plan view of a slide member and a fourth form of the hanging element of the assembly wherein the hanging portion of the hanging element has a substantially S-shaped configuration.
Figure 8:
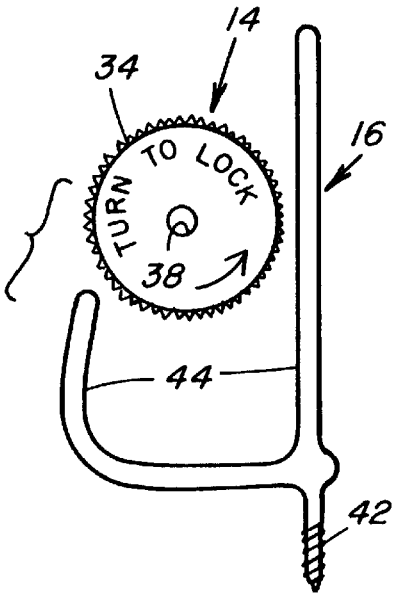
FIG. 8 is a further plan view of a slide member and a third form of the hanging element of the assembly wherein the hanging portion of the hanging element has a substantially L-shaped configuration.
Figure 10:
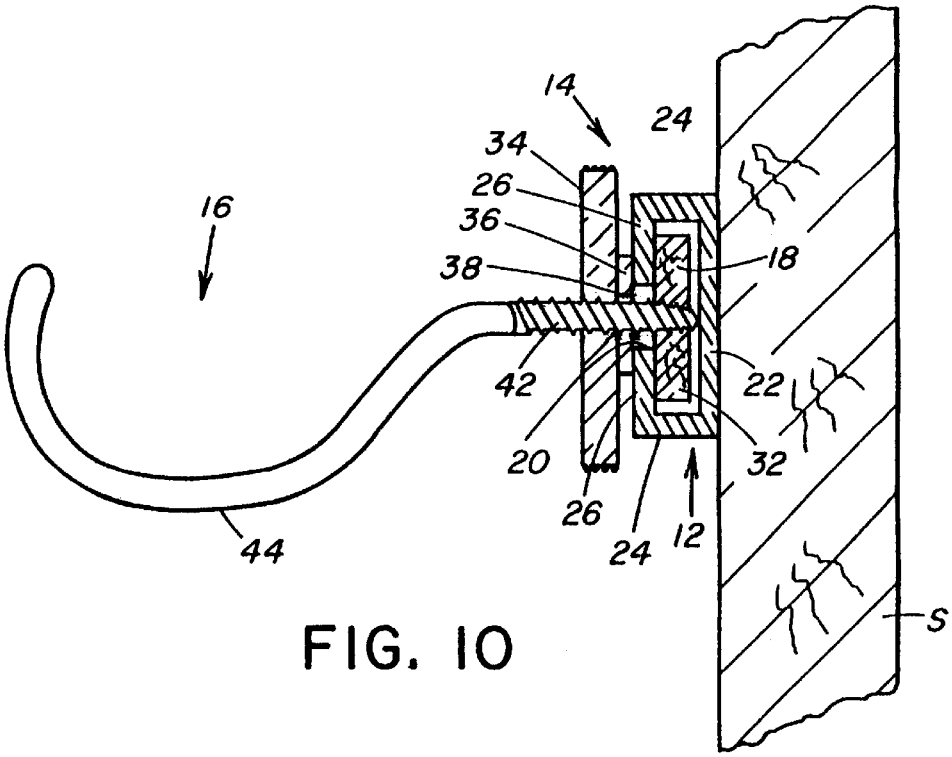
FIG. 10 is a partially side elevational and partially cross-sectional view of the assembly similar to that shown in FIG. 2 but now showing a modified form of the assembly wherein the slide member has a two-piece configuration rather than the one-piece configuration of FIG. 2.
Figure 14:
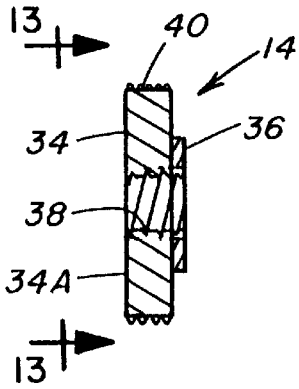
FIG. 14 is a cross-sectional view of the front and middle portions of the slide member taken along line 14—14 of FIG. 13.
Figure 13:
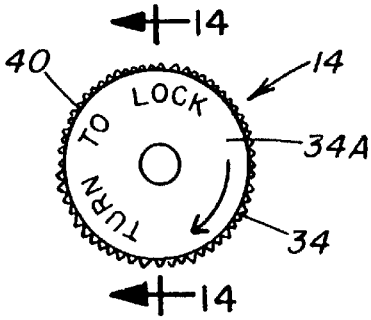
FIG. 13 is a front elevational view on a reduced scale of front and middle portions of the slide member as seen along line 13—13 of FIG. 14.
Figure 12:
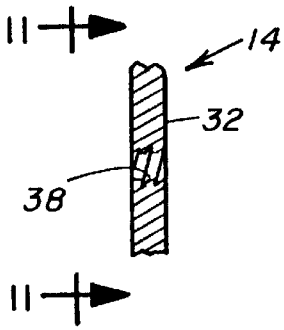
FIG. 12 is a cross-sectional view of the rear retaining portion of the slide member taken along line 12—12 of FIG. 11.
Figure 11:
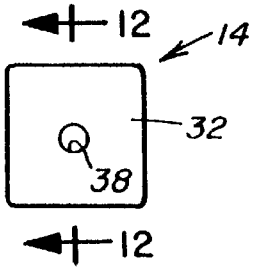
FIG. 11 is a front elevational view on a reduced scale of a rear retaining portion of the slide member as seen along line 11—11 of FIG. 12.
Figure 15:
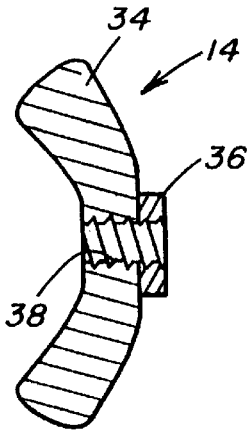
FIG. 15 is a side elevational view of the slide member of the assembly similar to that shown in FIG. 10 but now showing a modified form of the front and middle portions of the slide member.
Figure 16:
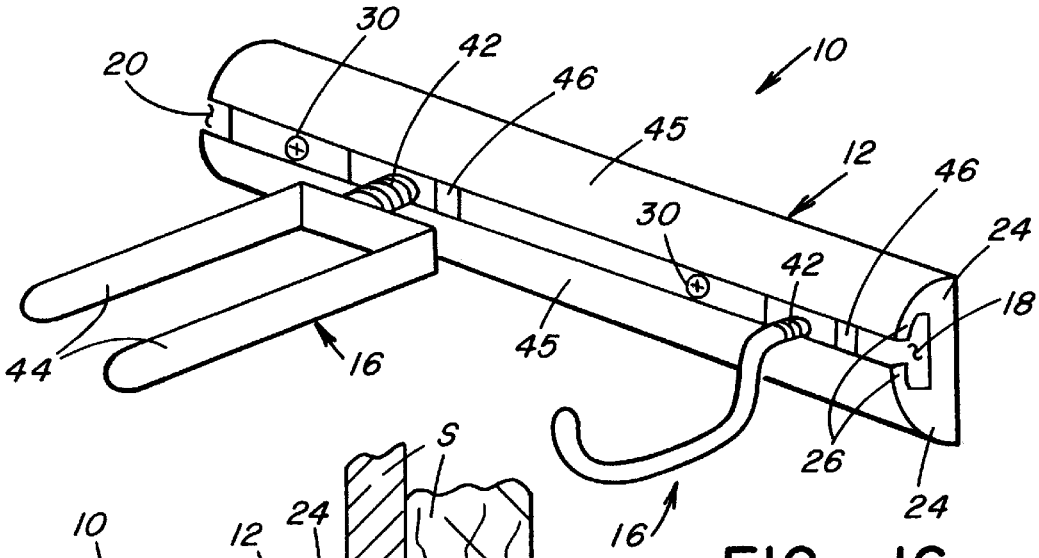
FIG. 16 is a perspective view of an alternative embodiment of the universal track hanger assembly of the present invention showing a track, a pair of slide members and a pair of hanging elements of the assembly.
Figure 17:
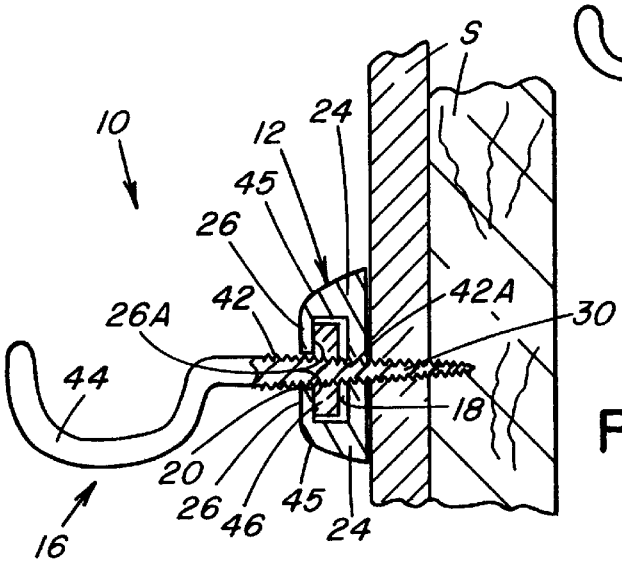
FIG. 17 is an enlarged partially cross-sectional and partially side elevational view of the assembly of FIG. 16, showing in cross-section the track and one of the slide members and in side elevation one of the hanging elements, with the assembly shown mounted to an external structural member.
Figure 18:
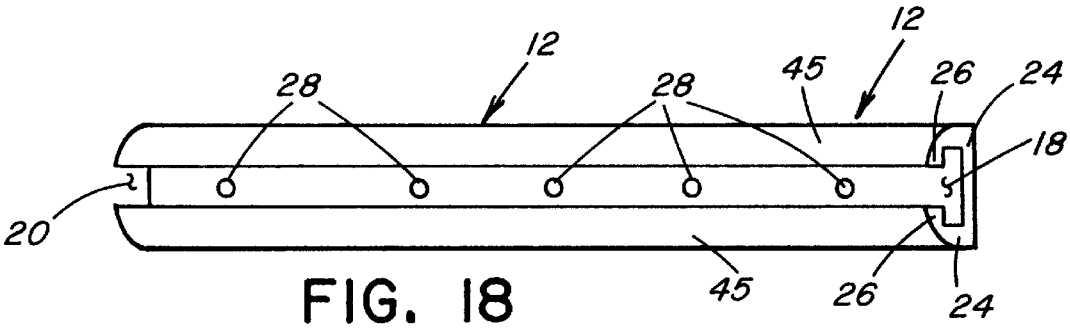
FIG. 18 is a perspective view of the track of the assembly of FIG. 16.
Figure 19:
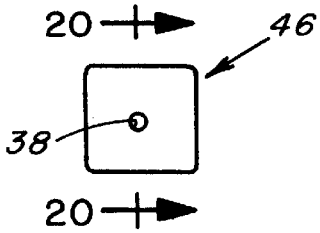
FIG. 19 is a front elevational view of one of the slide members of the assembly of FIG. 16 as seen along line 19—19 of FIG. 20.
Figure 20:
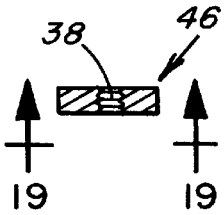
FIG. 20 is a cross-sectional view of the slide member taken along line 20—20 of FIG. 19.

Referring now to FIGS. 10 to 14, in a modification of the preferred embodiment of the assembly 10 of the present invention, the slide member 14 of the assembly 10 has a two-piece configuration rather than the one-piece configuration in the preferred embodiment of FIGS. 4 and 5. The middle portion 36 of the slide member 14 is not connected to the rear retaining portion 32 thereof. It is the front wall ledges 26 of the track 12 that are clamped between the middle portion 36 at the front of the front wall ledges 26 and the rear retaining portion 32 at the rear of the front wall ledges 26 so as to retain the hanging element 16 in the second position rather than the end portion 42 of the hanging element 16 being tightened against the back wall 22 of the track 12 as in the preferred embodiment. FIG. 15 shows a modification of the front and middle portions 34, 36 of the slide member 14 in the form of a wing nut.

Referring now to FIGS. 16 to 20, there is illustrated an alternative embodiment of the assembly 10 of the present invention which includes a differently configured track 12. The track 12 of the alternative embodiment has a pair of spaced apart front surfaces 45. Each front surface 45 is formed by one of the opposite side walls 24 and the adjacent one of the opposing front wall ledges 26. Each front surface 45 has a substantially curved configuration and, thus, the track 12 of the alternative embodiment does not have the substantially rectangular configuration of the track 12 of the preferred embodiment. The assembly 10 of the alternative embodiment also includes a slide member 46 instead of the slide member 14 of the preferred embodiment. The slide member 46 has a substantially rectangular configuration which conforms to the configuration of the channel 18 of the track 12. The slide member 46 has a size which is slightly less than the dimensions of the channel 18 of the track 12 so as to permit longitudinal slidable movement of the slide member 46 but to prevent any significant rotation of the slide member 46 within the channel 18 of the track 12. The slide member 46 does not have gripping and connecting portions 34, 36 like the slide member 14. The slide member 46 defines the internally threaded opening 38 aligned with the slot 20 of the track 12.

Here, securing the hanging element 16 is generally achieved by the same process, but the hanging element 16 is rotated instead of the slide member 46. The hanging element 16 is rotatable in opposite directions for threadably inserting and removing the end portion 42 of the hanging element 16 into and from the opening 38 of the slide member 46 and for moving the end portion 42 of the hanging element 16 between the first and second positions.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A universal track hanger assembly, comprising:

(a) an elongated track including a back wall, a pair of opposite side walls spaced apart from one another and connected to and extending forwardly from said back wall and a pair of opposing front wall ledges spaced forwardly from said back wall and connected to said side walls and extending toward and spaced from one another such that said back wall, opposite side walls and front wall ledges define therebetween a longitudinal channel and said opposing front wall ledges define therebetween a front longitudinal slot opening to said channel and have back sides facing toward said back wall;

(b) at least one slide member disposable at least partially and slidably movable longitudinally within said channel of and securable at selected locations along said track in relation to said track, said slide member having an internally threaded opening defined therethrough and aligned with said slot of said track when said slide member is disposed in said channel of said track; and (c) at least one hanging element having a hanger portion for extending from said track and an externally threaded end portion being insertable through and removable from said slot of said track and also being threadably insertable through said internally threaded opening of said slide member and across said channel toward said back wall of said track and further being movable with said slide member relative to said track such that said hanging element and slide member are threadably movable in relation to one another and movable in relation to said track between a first position and a second position wherein said first position said hanging element and slide member are loosened relative to said track such that said externally threaded end portion of said hanging element and said slide member are respectively loosened relative to said back wall and said back sides of said front wall ledges of said track and said hanging element and slide member are thereby permitted to undergo longitudinal slidable movement relative to and along said track so as to permit placement of said hanging element and slide member at a desired location along said track and wherein said second position said hanging element and slide member are tightened relative to said track such that an end of said externally threaded end portion of said hanging element projects rearwardly from said slide member and is tightened against said back wall of said track and said slide member is tightened against back sides of said front wall ledges of said track and said hanging element and slide member are thereby secured at said desired location along said track so as to prevent displacement of said hanging element and slide member along said track from said desired location.

2. The assembly of claim 1 wherein said slide member includes:

a rear retaining portion disposable within and slidable along said channel of said track and adapted to retain said hanging element in sliding relation to said track; and a front gripping portion disposable externally of and adjacent to said track and adapted to be gripped by a user.

3. The assembly of claim 2 wherein said slide member further includes a middle portion disposed between and fixedly interconnected to said rear retaining portion and said front gripping portion of said slide member, said internally threaded opening being defined through said rear retaining portion, front gripping portion and middle portion such that rotation of said front gripping portion in opposite directions rotates said middle and rear retaining portions therewith in said opposite directions and causes threadable insertion and removal of said externally threaded end portion of said hanging element into and from said internally threaded opening of said slide member toward and away from said back wall of said track and between said first and second positions.

4. The assembly of claim 3 wherein said middle portion of said slide member is disposable substantially within said slot of said track and extends between and interconnects said rear retaining portion and front gripping portion.

5. The assembly of claim 3 wherein each of said rear retaining portion, front gripping portion and middle portion of said slide member has a substantially circular configuration.

6. The assembly of claim 5 wherein each of said rear retaining portion, front gripping portion and middle portion of said slide member has a diameter, said diameter of said rear retaining portion being less than said diameter of said front gripping portion and being greater than said diameter of said middle portion.

7. The assembly of claim 1 wherein:

said channel of said track has a substantially rectangular configuration in cross-section;

said slide member has a substantially rectangular configuration conforming to said configuration of said channel of said track.

8. The assembly of claim 1 wherein said hanger portion is in the configuration of a hook.

9. The assembly of claim 1 wherein said hanger portion has a substantially U-shaped configuration.

10. The assembly of claim 1 wherein said hanger portion has a substantially L-shaped configuration.

11. The assembly of claim 1 wherein said hanger portion has a substantially S-shaped configuration.

* * * * *